US005542561A

United States Patent [19]

Slink et al.

[11] Patent Number: 5,542,561

[45] Date of Patent: Aug. 6, 1996

[54] COMPACT OR CONTAINER WITH ATTACHED CAP AND OPTIONAL AIRTIGHT CLOSURE

[75] Inventors: John J. Slink, Greenwich, Conn.; Anna Mecca, Ridgefield, N.J.

[73] Assignee: Jerhel Plastics, Inc., Bayonne, N.J.

[21] Appl. No.: 323,757

[22] Filed: Oct. 17, 1994

[51] Int. Cl.[6] ..... B65D 41/04; A45D 33/00

[52] U.S. Cl. ..... 220/291; 220/334; 132/293; 206/581; 206/823

[58] Field of Search ..... 220/291, 292, 220/334, 319, 375; 206/581, 823; 132/293, 294, 300

[56] References Cited

U.S. PATENT DOCUMENTS

| | | | |
|---|---|---|---|
| 1,529,145 | 3/1925 | Seymour | 220/334 X |
| 1,539,823 | 6/1925 | Baldwin | 220/291 |
| 1,607,961 | 11/1926 | Maker et al. | 220/291 |
| 1,694,185 | 12/1928 | Leberman | 220/291 |
| 1,710,140 | 4/1929 | Behrman | 220/291 |
| 1,912,929 | 6/1933 | Wolf | 220/291 X |
| 2,142,636 | 1/1939 | Evensen | 220/291 |
| 2,147,246 | 2/1939 | Dahl | 220/291 |
| 2,184,592 | 12/1939 | Harrison | 220/291 |
| 2,466,295 | 4/1949 | Algier | 220/291 |

FOREIGN PATENT DOCUMENTS

| | | | |
|---|---|---|---|
| 588245 | 2/1959 | Italy | 220/291 |

*Primary Examiner*—Allan N. Shoap
*Assistant Examiner*—Nathan Newhouse
*Attorney, Agent, or Firm*—Jean-Marc Zimmerman

[57] ABSTRACT

A compact or other container creates, when closed, an airtight closure for holding, storing or packaging material, such as cosmetics. The cap of the container screws onto the jar portion of the container via complementary threads, but the cap is permanently connected to the jar by a collar which allows the cap to freely rotate. The cap of the container contains a liner which is forced against the lip of the jar, thereby forming an airtight seal. Also disclosed is a compact or other container which need not have an airtight closure but with a cap that is permanently connected to the jar.

11 Claims, 4 Drawing Sheets

COMPACT OR CONTAINER WITH ATTACHED CAP AND OPTIONAL AIRTIGHT CLOSURE

BACKGROUND OF THE INVENTION

1. Field of the Invention

This invention relates generally to airtight containers and more particularly to compacts adapted for holding, storing, or packaging ultramoist powders and materials such as water-based cosmetics; powders; emulsions, creams, and other semi-solid or paste-type items.

2. Description of the Prior Art

For many storage applications, it is extremely undesirable to allow the stored material to either absorb moisture from the ambient surroundings or to lose moisture to these surroundings. Typical examples are cosmetics. Some cosmetics come in a dry, powder form and must maintain this powdery form in order to be used properly. If exposed to the air for extended periods, the powder will absorb moisture and begin to "cake", thereby losing its powdery consistency. Consequently, these cosmetics can no longer be used as intended.

The reverse situation is also true. Some cosmetics come in "supermoisturized" and must maintain this supermoist form in order to be used properly. If exposed to the air for extended periods, the material will lose moisture to the air, thereby losing its supermoist consistency. Consequently, these cosmetics can no longer be used as intended.

To prevent these undesired occurrences, the materials are stored in airtight containers. Compacts and other containers having airtight closures are known in the prior art. As illustrated in U.S. Pat. Nos. 4,454,889 and 5,186,318, the prior art shows an airtight seal formed by deformation of the inner surface of a base or closure member of the compact when that member is brought into contact with an opposing member of the compact.

Although these prior art containers do provide an airtight seal, in use they have a major disadvantage. To both achieve and undo the airtight seal requires application of significant force to close and open the compact, respectively. During the application of this sizable force, injuries may result to the user; broken nails and abrasions are common. Furthermore, when undoing the airtight seal, the applied force often causes some of the stored material to fly out of the container, thereby wasting that flying material and possibly staining or otherwise damaging surfaces upon which that flying material lands.

Thus, there is a need for a compact or other container with an airtight closure that requires less force to both achieve and undo the airtight seal.

SUMMARY OF THE INVENTION

An object of this invention is to provide a compact or other container which minimizes the possibility of losing the cover when the cover is removed.

Another object of this invention is to provide a compact or other container with an airtight closure which substantially eliminates the escape of moisture therefrom and at the same time provides easy and convenient access to the product in the compact.

Still another object of-this invention is to provide a compact or other container with an airtight closure sufficient to retain the moisture in an ultramoist product contained therein in which the normal mechanical action of opening and closing the compact is not affected to any measurable degree.

Still another object of this invention is to provide a compact or other container with an airtight closure that uses parts of simple construction, capable of being produced at a relatively low cost, easy to assemble, durable in its operation and aesthetically appealing in appearance.

In short, the present invention provides an improved compact with an airtight closure and an attached, threaded cover containing a liner that forms an airtight seal when the threaded cover is engaged against the lip of the compartment contained in the base of the compact. A collar attached to the base of the compact holds the threaded cover so that the threaded cover can be freely rotated while in the collar. When the threaded cover of the compact is rotated to the open position, the threaded cover remains attached to the base. A second embodiment is a compact or other container which need not have an airtight closure but has a cap that is permanently connected to the jar.

An advantage of the present invention is the attainment of an airtight seal with the ease of closing a jar. The present invention forms an airtight seal that is neither too difficult to open, which could result in accidental spillage of the contents if too much force is used to open the compact, nor is the seal so loose that the contents dry out over a period of time.

An additional advantage of the present invention is that once the top closure is removed from the base of the compact, the compact remains intact because the top closure is still attached to the base by means of the collar.

DESCRIPTION OF PREFERRED EMBODIMENT

Figure 1:
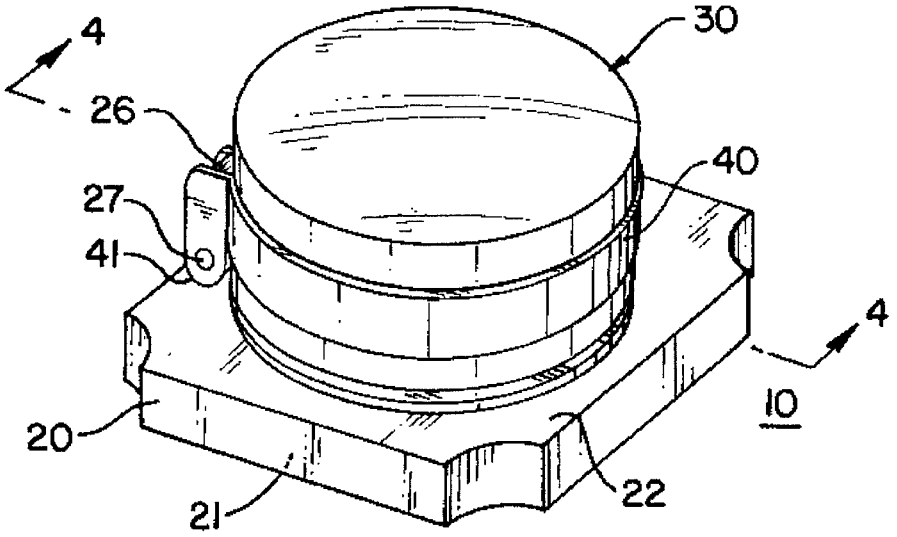
FIG. 1 is a right side view of the compact when closed.
Figure 2:
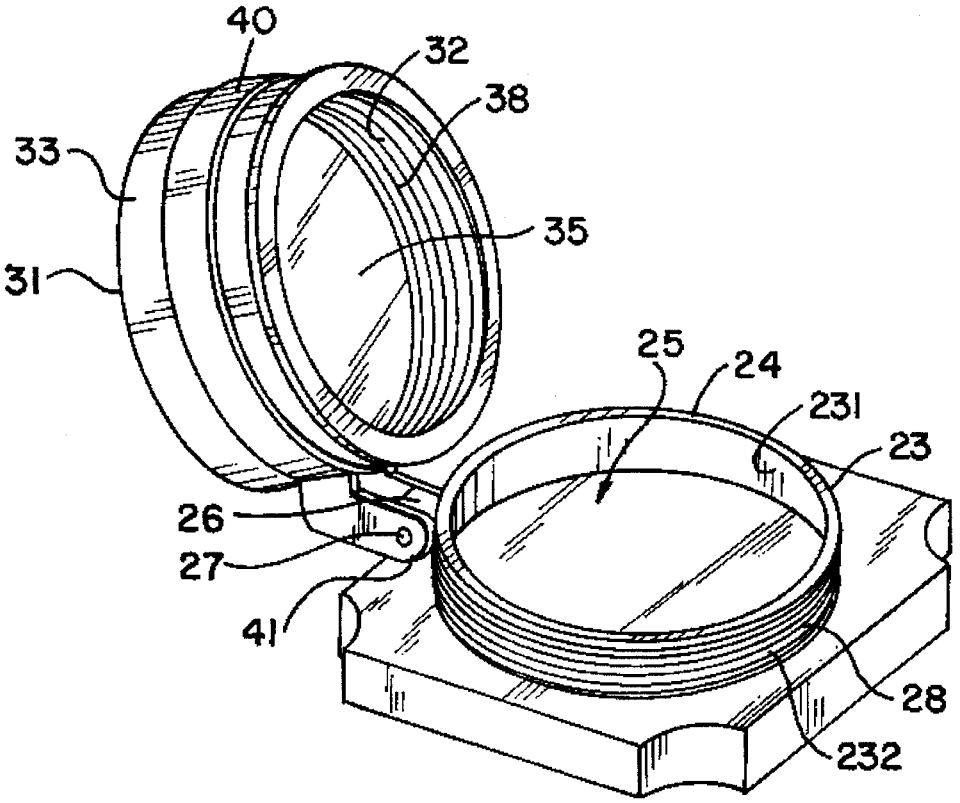
FIG. 2 is a right side view of the compact shown in FIG. 1 when open.

In its preferred embodiment, this invention is a compact 10. The compact 10 includes a base assembly 20 and a cap closure assembly 30.

The base assembly 20 has a bottom surface 21 and a top surface 22, with a generally circular wall 23 projecting upwards from the top surface 22 of the base assembly 20 and terminating in a lip 24. The inner surface 231 of the wall 23 is continuous and forms a compartment 25 therebetween. The compartment 25 is used to hold, store or package cosmetics in the present invention. A receptacle 26 on the top surface 22 of the base assembly 20 contains an opening 27 to receive a fastener 43 that pivotally engages the ends 41 of the collar 40. Threads 28 on the outer surface 232 of the wall 23 engage corresponding threads 38 on the inner surface 32 of cap closure assembly 30 to effect closure of the compact when cap closure assembly 30 is rotated.

The cap closure assembly 30 includes a cover 31 which has both an inner surface 32 and an outer surface 33. Cover 31 contains along its inner surface 32 a cap liner 35. Cap liner 35 can be made from foam, aluminum covered paper, cork, plastic, polytetrafluoroethylene, rubber or other materials known to persons skilled in the art. Cap liner 35 forms an airtight seal when cap closure assembly 30 is engaged and cap liner 35 is in direct and continuous contact with lip 24 of compartment 25.

Figure 3:
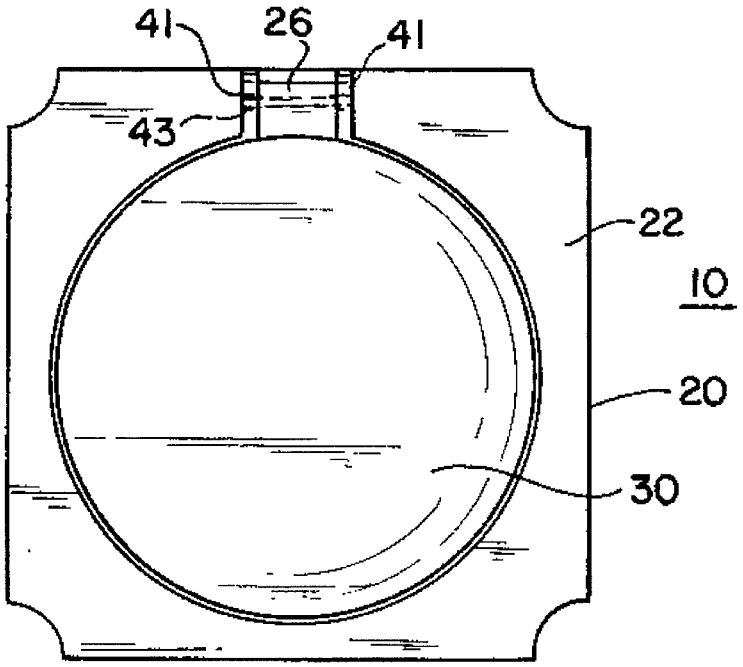
FIG. 3 is a top plan view of the compact shown in FIG. 1.
Figure 4:
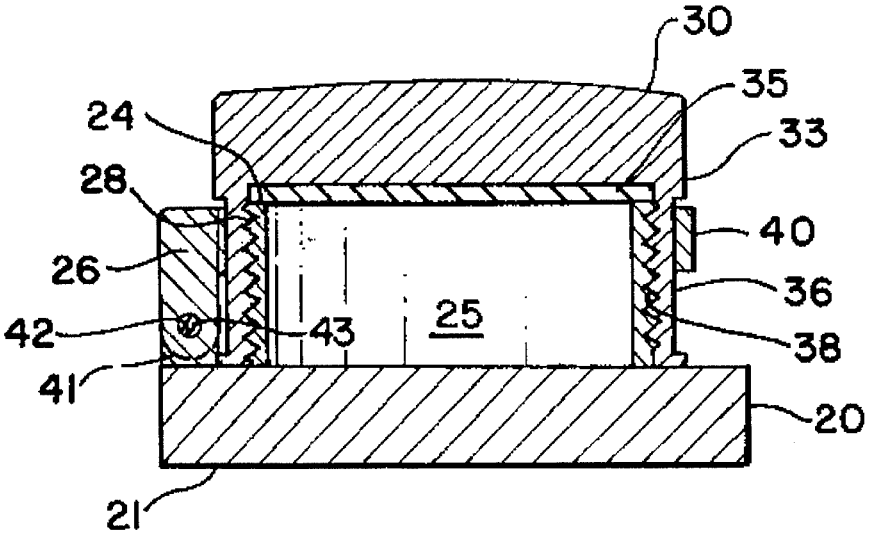
FIG. 4 is a vertical section of the compact as shown in FIG. 1 along line A—A.
Figure 5:
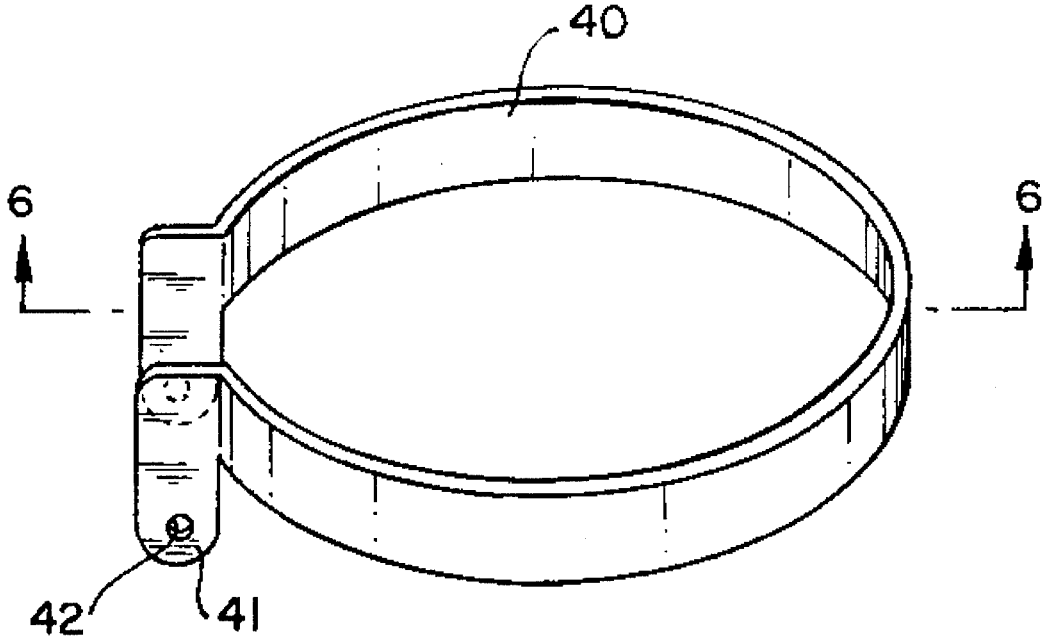
FIG. 5 is a right side elevational view of the collar.
Figure 6:
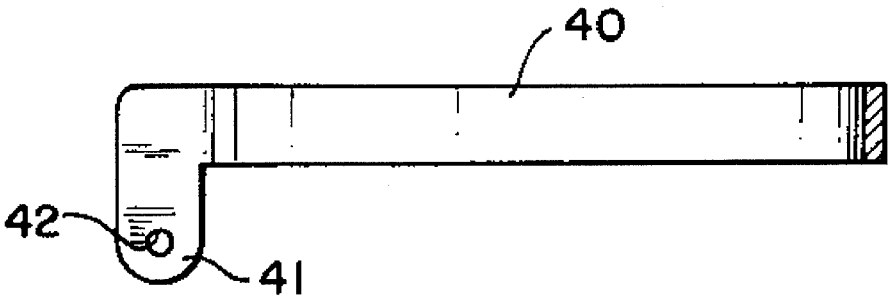
FIG. 6 is a vertical section of the collar shown in FIG. 5 taken on line B—B.

Cap closure assembly 30 must be in the closed position to achieve the airtight seal with lip 24. Inner surface 32 of the cap contains threads 38 that engage corresponding threads 28 on the outer surface of compartment 25. When the cap assembly is rotated in one direction, the threads engage and the cap assembly is brought into a closed position, as shown in FIG. 4. Cap liner 35 is then in direct and continuous contact along lip 24 of compartment 25, thereby forming an airtight seal. This operation is reversed to open the compact 10. Thus, when the cap assembly 30 is rotated in the opposite direction, the threads disengage and cap assembly 30 can be separated from lip 24 and compartment Outer surface 33 of cover 31 contains an annular groove 36. Collar 40 surrounds annular groove 36 of cover 31, the diameter of collar 40 being slightly larger than the diameter of annular groove 36 enabling the cap closure assembly 30 to be freely rotated while retained within collar 40. As shown in FIG. 5 and FIG 6,the ends or ears 41 of collar 40 are bent at a right angle downwardly from the collar 40, each end or ear 41 containing an aperture 42 for receiving a fastener 43, to retain cap closure assembly 30 within collar 40. Receptacle 26 is centrally disposed between ends 41, with ends 41 attached to receptacle 26 and to each other by fastener means 43, as shown in FIG. 3. The fastener means may be a pivot pin, a rod, a pin, a screw or similar means, and can be made of brass, steel, stainless steel, aluminum or other similar material, although the preferred embodiment is brass.

Ends 41 of the collar 40 are of a length that enables collar 40 to be attached to the receptacle 26 yet allow for pivotal movement of the collar 40 and the cap closure assembly 30 with respect to the base assembly 20 when the cap closure assembly 30 is moved from the closed to the open position. When the compact 10 is closed, the contents of the compartment are protected from evaporation by the airtight seal, yet the compact 10 can be easily opened like a jar. When opened, the cap closure assembly 30 remains attached to the base assembly 20 of the compact 10, thereby eliminating the possibility of losing the cap closure assembly 30, which is the means for properly reclosing the compact 10.

The base assembly 20 and the cap closure assembly are preferably molded from plastic materials such as acrylonitrile-butadiene-styrene (ABS) and polycarbonate having the strength and appearance to provide a compact adapted for the commercial marketplace. The collar 40 can be molded from similar plastics or can be fabricated from metals such as steel, stainless steel or brass.

While the compact 10 illustrated is round in plan view, it will be understood by those skilled in the art that the shape and size of the particular compact which utilizes the improved airtight seal and closure in accordance with the present invention, will be in accordance with the desired commercial requirements for the particular unit.

Figure 7:
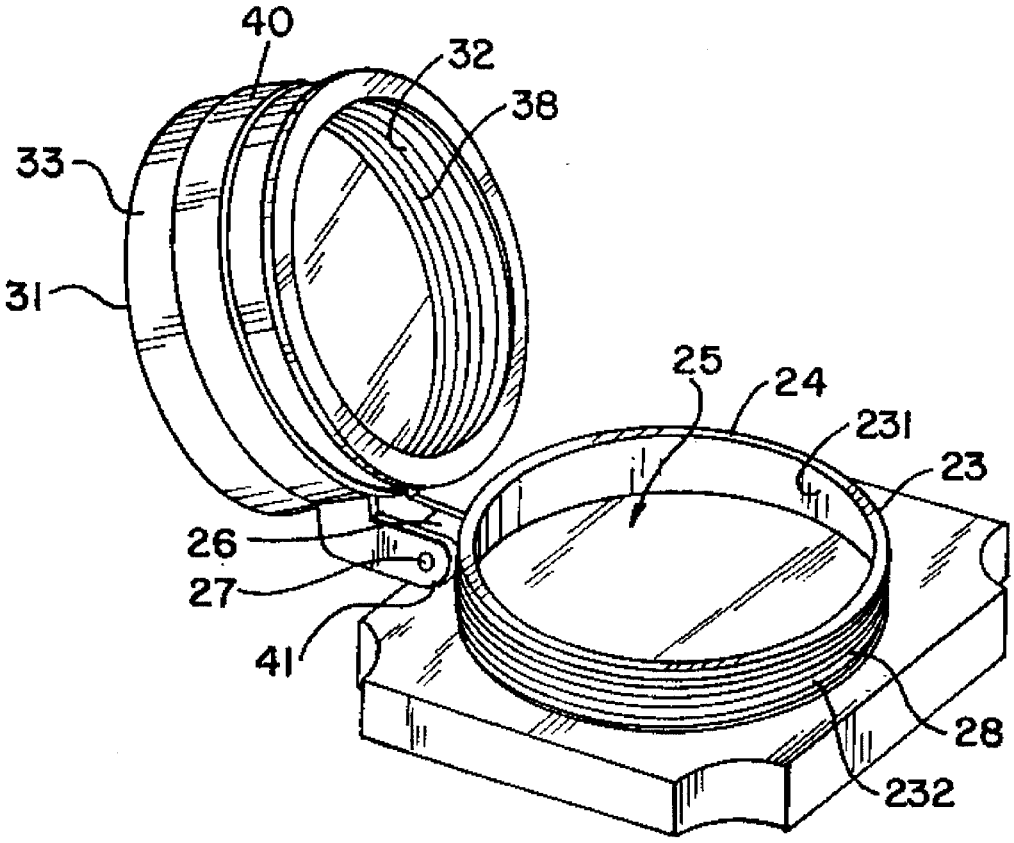
FIG. 7 is a right side view of a second embodiment of the compact shown in FIG. 1 when open.
Figure 8:
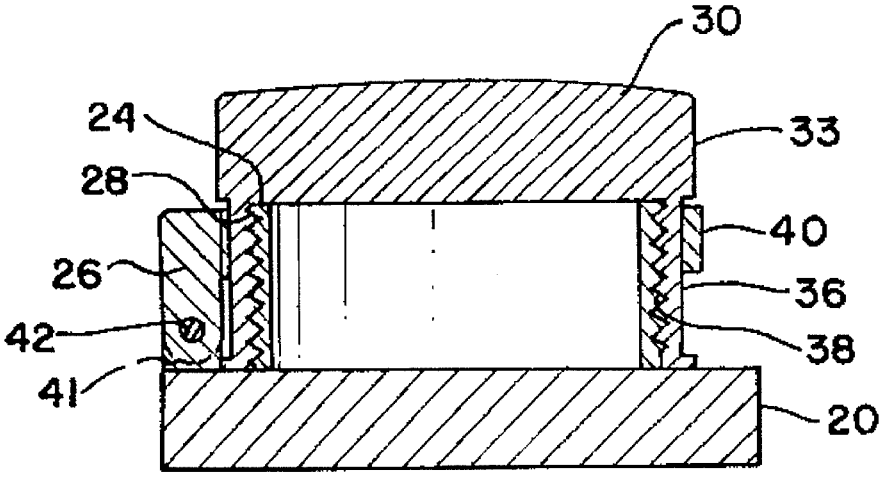
FIG. 8 is a vertical section of the compact embodiment shown in FIG. 7 along line A—A of FIG. 1.

A second embodiment of this invention (see FIG. 7) comprises a compact or container 10 as described above, but in which there is no cap liner 35. In this embodiment, the compact or container 10 may not be airtight, but will minimize the stored material's absorption of moisture from or loss of moisture to the ambient surroundings. Significantly, as above, this compact or container 10 prevents loss of the cap closure assembly 30 when opened.

This embodiment is particularly useful when an airtight seal is not necessary, or even detrimental to the stored material, but the user wants to prevent losing the container's cap.

Although this invention has been described with a certain degree of particularity, it is to be understood that the present disclosure has been made only by way of illustration and that numerous changes in the details of construction and arrangement of parts may be resorted to without departing from the spirit and scope of the invention.

We claim:

1. A container with an attached closure system comprising:

a. a base assembly comprising:
  a jar having a jar top surface;
  a continuous wall projecting upward from the jar top surface, the wall having a wall outer surface and a wall unattached end;
  cap receiving means for threadably receiving a cap, the cap receiving means being disposed on the wall outer surface; and
  collar holding means being disposed on the jar top surface;

b. a cap having a cap inner surface and a cap outer surface, the cap comprising:
  cap engaging means for threadably engaging the cap receiving means, the cap engaging means being disposed on the cap inner surface; and
  collar confinement means being disposed on the cap outer surface; and c. a collar being pivotally confinable around the cap by the collar confinement means, the collar having a first closed end surrounding the cap, the collar further having two arms extending from the first closed end towards an open second end, each one of the arms terminating at the open second end and having an ear extending downwardly and at a right angle from each said arm adjacent said second end, each arm having an opening generally parallel to and aligned with the collar holding means, the collar having an axial length greater than its thickness;
  such that when the cap engaging means and the cap receiving means are disengaged and the cap is separated from the base assembly, the cap is pivotally attached to the base assembly by the collar.

2. A container with an airtight closure system comprising:

a. a base assembly comprising:
  a jar having a jar top surface;
  a continuous wall projecting upward from the jar top surface, the wall having a wall outer surface and a wall unattached end;
  a lip at the wall unattached end;
  cap receiving means for threadably receiving a cap, the cap receiving means being disposed on the wall outer surface; and
  collar holding means being disposed on the jar top surface;

b. a cap having a cap inner surface and a cap outer surface, the cap comprising:
  cap engaging means for threadably engaging the cap receiving means, the cap engaging means being disposed on the cap inner surface; and collar confinement means being disposed on the cap outer surface; and c. a collar being pivotally confinable around the cap by the collar confinement means, the collar having a first closed end surrounding the cap, the collar further having two arms extending from the first closed end towards an open second end, each one of the arms terminating at the open second end and having an ear extending downwardly and at a right angle from each said arm adjacent said second end, each arm having an opening generally parallel to and aligned with the collar holding means, the collar having an axial length greater than its thickness;

such that when the cap engaging means engage the cap receiving means and the cap is rotated to a closed position with respect to the base assembly, the cap is in contact with the lip to form an airtight seal; and such that when the cap engaging means and the cap receiving means are disengaged and the cap is separated from the base assembly, the cap is pivotally attached to the base assembly by the collar.

3. A container as described in claim 2 in which the cap further comprises a cap liner being attachable to the cap inner surface.

4. A container as described in claim 2 in which:

the collar has a width generally perpendicular to the plane of the collar; and the collar confinement means comprises an annular groove having a groove width slightly larger than the collar width.

5. A container as described in claim 4 in which:

the second collar end has an collar opening generally perpendicular to the orientation of the collar width; and the collar holding means has a holding opening generally parallel to the orientation of the collar opening;

such that when the collar holding means holds the second collar end, the collar opening and the holding opening are generally aligned with each other; and the container further comprises a fastener to hold together the collar holding means and the collar by utilizing the collar opening and the holder opening.

6. The container as described in claim 5 wherein the fastener is a pin.

7. The container as described in claim 6 wherein the fastener is a screw.

8. The container as described in claim 5 wherein the fastener is a rivet.

9. The container as described in claim 5 wherein the fastener is a pivot pin.

10. A container with an airtight closure system comprising:

a. a base assembly comprising;

a jar having a jar top surface;

a continuous wall projecting upward from the jar top surface, the wall having a wall outer surface and a wall unattached end;

a lip at the wall unattached end;

cap receiving means for threadably receiving a cap, the cap receiving means being disposed on the wall outer surface; and collar holding means being disposed on the jar top surface, the collar holding means having a holding opening;

b. a cap having a cap inner surface and a cap outer surface, the cap comprising:

cap engaging means for threadably engaging the cap receiving means, the cap engaging means being disposed on the cap inner surface;

collar confinement means being disposed on the cap outer surface, the collar confinement means comprising an annular groove having a groove width generally perpendicular to the plane of the groove; and a cap liner being attachable to the cap inner surface;

c. a collar being pivotally confinable around the cap by the collar confinement means, the collar having a collar width generally perpendicular to the plane of the collar being slightly smaller than the groove width, the collar having a first closed end surrounding the cap, the collar further having two arms extending from the first closed end towards an open second end, each one of the arms terminating at the open second end and having an ear extending downwardly and at a right angle from each said arm adjacent said open second end, each arm abridging and being aligned with and being coupled to the collar holding means, the collar having an axial length greater than its thickness, each collar end having a collar opening generally perpendicular to the orientation of the collar width and being generally alignable with and generally parallel to the orientation of the holder opening;

d. a collar closer to keep the collar ends close enough to each other so that the collar remains within the groove; and e. a fastener to hold together the collar holding means and the collar by utilizing the collar opening and the holder openings when these openings are generally aligned, the collar end being holdable in the collar holding means;

such that when the cap engaging means engage the cap receiving means and the cap is rotated to a closed position with respect to the base assembly, the cap is in contact with the lip to form an airtight seal; and such that when the cap engaging means and the cap receiving means are disengaged and the cap is separated from the base assembly, the cap is pivotally attached to the base assembly by the collar.

11. An airtight closure system for use with a storage jar, the jar having a jar top surface, a continuous wall projecting upward from the jar top surface, the wall having a wall outer surface and a wall unattached end, and a lip at the wall unattached end, the airtight closure system comprising:

a. cap receiving means for threadably receiving a cap, the cap receiving means being disposed on the wall outer surface b. collar holding means being disposed on the jar top surface;

c. a cap having a cap inner surface and a cap outer surface;

cap engaging means for threadably engaging the cap receiving means, the cap engaging means being disposed on the cap inner surface; and collar confinement means being disposed on the cap outer surface; and d. a collar being pivotally confinable around the cap by the collar confinement means, the collar having a first closed end surrounding the cap, the collar further having two arms extending from the first closed end towards an open second end, each one of the arms terminating at the open second end and having an ear extending downwardly and at a right angle from each said arm adjacent said second end, each arm having an opening generally parallel to and aligned with the collar holding means, the collar having an axial length greater than its thickness;

such that when the cap engaging means engage the cap receiving means and the cap is rotated to a closed position with respect to the jar, the cap is in contact with the lip to form an airtight seal; and such that when the cap engaging means and the cap receiving means are disengaged and the cap is separated from the jar, the cap is pivotally attached to the jar by the collar.

* * * * *